United States Patent [19]

Deutsch et al.

[11] 4,249,448

[45] Feb. 10, 1981

[54] EVEN-ODD SYMMETRIC COMPUTATION IN A POLYPHONIC TONE SYNTHESIZER

[75] Inventors: Ralph Deutsch; Leslie J. Deutsch, both of Sherman Oaks, Calif.

[73] Assignee: Kawai Musical Instrument Mfg. Co. Ltd., Hamamatsu, Japan

[21] Appl. No.: 28,038

[22] Filed: Apr. 9, 1979

[51] Int. Cl.[3] ..... G10H 1/08

[52] U.S. Cl. ..... 84/1.23

[58] Field of Search ..... 84/1.01, 1.03, 1.22, 84/1.23; 364/419, 718, 721

[56] References Cited

U.S. PATENT DOCUMENTS

| | | | |
|---|---|---|---|
| 3,763,364 | 10/1973 | Deutsch et al. | 84/1.03 X |
| 3,809,788 | 5/1974 | Deutsch | 84/1.01 |
| 4,022,098 | 5/1977 | Deutsch et al. | 84/1.03 |
| 4,067,254 | 1/1978 | Deutsch et al. | 84/1.01 |
| 4,085,644 | 4/1978 | Deutsch et al. | 84/1.01 |

*Primary Examiner*—S. J. Witkowski

*Attorney, Agent, or Firm*—Ralph Deutsch

[57] ABSTRACT

In a musical instrument having one or more tone generators in which a plurality of data words corresponding to the amplitudes of a corresponding number of evenly spaced reference points defining the waveform of one cycle of an audio signal are transferred sequentially from a note register to a digital-to-analog converter in repetitive cycles at a rate proportional to the pitch of the tone being generated, apparatus is provided for computing the set of data points in the note register from a set of points defining a quarter cycle of the waveform. The calculation of the quarter cycle of data points is divided into two sets. One set is calculated using the odd-numbered harmonics and the other set is caculated using the even-numbered harmonics. The complete waveform is reconstructed from the two sets during the transfer of data to the note registers. By reducing the number of calculated points to one-quarter of a waveform the calculation time is reduced thereby making the instrument capable of faster response to time varying tonal changes.

12 Claims, 8 Drawing Figures

EVEN-ODD SYMMETRIC COMPUTATION IN A POLYPHONIC TONE SYNTHESIZER

FIELD OF THE INVENTION

This invention relates to the production of musical waveshapes, and in particular it is concerned with an improvement for generating such waveshapes in a polyphonic tone synthesizer.

BACKGROUND OF THE INVENTION

In U.S. Pat. No. 4,085,644 there is described a Polyphonic Tone Synthesizer in which a master data set is computed and stored in a main register from which it is transferred to note registers of a plurality of tone generators. The master data set defines the amplitudes of equally spaced points along a half cycle of the audio waveform of the musical tones being generated. Each tone generator receives the words in the master data set and applies them to a digital-to-analog converter at a rate determined by the fundamental pitch of the respective tones being generated by the Polyphonic Tone Synthesizer.

One of the features of the Polyphonic Tone Synthesizer, as described in the above-identified patent, is that the transfer of successive words from the master data set in the main register to an individual note register in the respective tone generators is synchronized with the transfer of words from the note register to the digital-to-analog converter in the respective tone generators. This feature permits the master data set defining the waveform to be recomputed and loaded in the respective tone generators without interrupting the generation of the respective musical notes by the tone generators, thus permitting the waveform of a musical tone to be changed with time without interrupting the resulting musical tone.

The rate at which the waveform can be varied as a function of time is limited by the length of time for a computation cycle during which the master data set is generated and the length of time required to transfer the data from the main register to the note registers in each of the tone generators. Methods for reducing the length of the transfer are described in the copending application Ser. No. 10,946 filed Feb. 9, 1979 entitled "Data Transfer Apparatus For Digital Polyphonic Tone Synthesizer." The referenced application and the present application have a common assignee.

An obvious method of reducing the time required for the computation cycle is to simply increase the frequency of the logic master clock which provides the timing signals for the system logic. There are practical as well as economic limitations imposed upon the speed, or frequency, of the master clock. If the Polyphonic Tone Synthesizer is implemented with microelectronics, then the present state-of-the-art limits the master clock to about 2 to 3 Mhz. Since the cost of microelectronics rises very fast with the high end of the speed limits, it is desirable to achieve a decreased computation cycle time without increasing the speed of the master clock.

In U.S. Pat. No. 4,085,644 a procedure was described for reducing the length of the computation cycle by one-half the time by computing 32 data words rather than the full set of 64 words used to define a master data set corresponding to a waveshape having a maximum of 32 harmonics. This reduction of one-half in the number of data points required by the master data set is accomplished by generating the master data having a prespecified symmetry of data points. The symmetry is obtained by using either only sine (or odd symmetric orthogonal functions) terms or only cosine (or even symmetric orthogonal functions) in the calculation of the master data set. The second 32 data words required by the note registers is obtained by reading the data from the main register forward and backward. In the backward read mode a 2's complement operation is applied to the addressed master data set words if the sine terms, or odd symmetric, calculations were used to generate the master data set. No change in the addressed master data set is required if the cosine terms, or even symmetric, calculations were used to generate the master data set.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is created by implementing a discrete Fourier algorithm using a stored set of harmonic coefficients which characterize a preselected musical tone. The computations are carried out at a fast rate which may be nonsynchronous with any musical frequency. Preferably the harmonic coefficients and the orthogonal functions required by the Fourier algorithm are stored in digital form and the computations are carried out digitally. At the end of a computation cycle the master data set is stored in a main register.

Following a computation cycle, a transfer cycle is initiated during which the master data set is transferred to preselected members of a multiplicity of note registers. Tone generation continues uninterrupted during the computation and the transfer cycles.

The present invention is directed to an improved arrangement for generating the master data set and for transferring the master data set from the main register to the note registers of the respective tone generators. By the present invention the number of data words in the master data set is reduced to 16 without reducing the 32 harmonic tone capability of the output musical waveshapes. The reduction of the master data set is accomplished by decomposing the master data set into two components. The first component is generated using only the odd harmonic coefficients and the second component is generated using only the even harmonic coefficients. The component master data sets are stored in two memories. During the transfer cycle, the desired full cycle wave shape data is created by forward and backward addressing of the data stored in the two memories. The addressed data is complemented and added in a specified manner so that the desired full cycle waveshape is created from 16 master data set points instead of using the 64 data points as required by the note registers. In this fashion, the time required for the creation of the master data set during the computation cycle is reduced by a factor of four corresponding to the generation of only 16 data points instead of the nominal 64 data points.

BRIEF DESCRIPTION OF THE DRAWINGS

The detailed description of the invention is made with reference to the accompanying drawings wherein like numerals designate like components in the figures.

DETAILED DESCRIPTION

Figure 1:
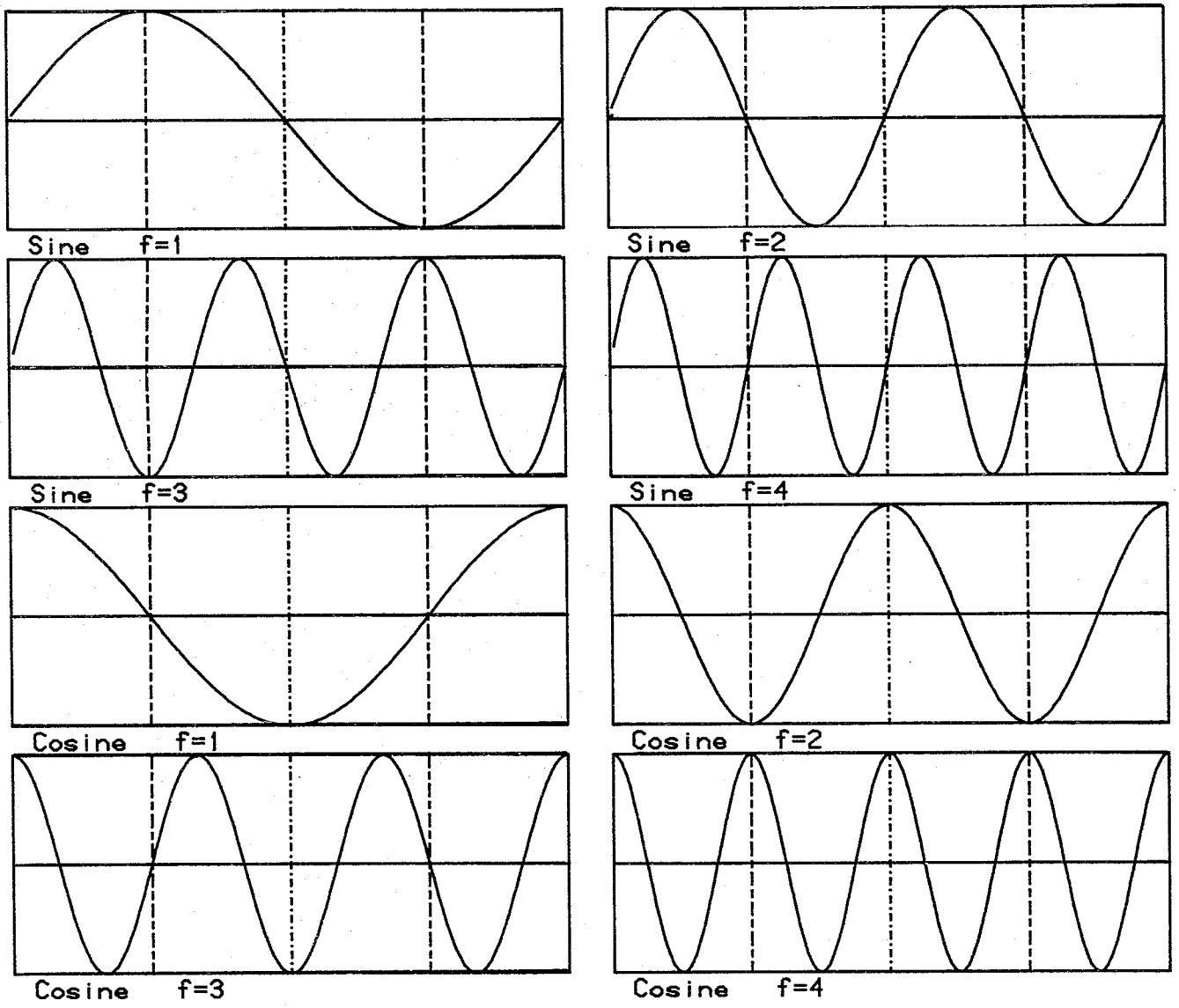
FIG. 1 is a graphic illustration of the waveshape symmetries of even and odd harmonics.

The embodiments of FIGS. 1–7 are shown and described as modifications to the Polyphonic Tone Synthesizer described in detail in U.S. Pat. No. 4,085,644, hereby incorporated by reference. All two-digit reference numbers used in the drawings correspond to the similarly numbered elements in the disclosure of the above-identified patent.

As described in the patent, the Polyphonic Tone Synthesizer includes an instrument keyboard 12 which, for example, corresponds to the conventional keyboard of an electronic musical instrument such as an electronic organ. By depressing one or more keys on the instrument keyboard, a note detect and assignor circuit 14 stores the note information for the keys that have been actuated and assigns each actuated note to one of twelve separate tone generators. A note detect and assignor circuit is described in U.S. Pat. No. 4,022,098 which is hereby incorporated by reference. When one or more keys has been depressed, an executive control circuit 16 initiates a computation cycle during which a master data set consisting of 32 words is computed and stored in a odd main register 34. The 32 words are generated with values which correspond to the amplitudes of 32 equally spaced points for one-half cycle of the audio waveform of the tone to be generated by the tone generators. The manner in which the Polyphonic Tone Synthesizer generates the waveform defining master data set is described in detail in U.S. Pat. No. 4,085,644.

At the completion of a computation cycle, the executive control 16 initiates a transfer cycle during which the master data set stored in the odd main register 34 is transferred to a note register 35 in the assigned tone genererators. The note register 35 stores 64 words corresponding to one complete cycle of the audio tone to be generated. As described in U.S. Pat. No. 4,085,644, the 32 words of the master data set residing in the odd main register 34 are expanded to 64 words in the note register 35 during the transfer cycle by using either the even or the odd symmetry of the Fourier series from which the master data set is generated. If even symmetry is used, that is, all cosine functions are used in the Fourier algorithm, it is only necessary to reverse the order of the 32 data points of the master data set to provide an additional 32 words defining the second half cycle in the note registers. If odd symmetry is used, that is, all sine functions are used in the Fourier algorithm, the order of the second group of 32 points must be reversed and the algebraic sign of the data must be changed by an operation such as performing a 2's complement with binary numbers.

Once the 64 data points which define one complete cycle of the desired audio waveshape are stored in the note register 35, the data points are read out of the note register 35 in sequence and applied to a digital-to-analog converter 47 which converts the input digital data into an analog voltage of the desired audio waveshape which is then applied to a sound system 11. The data points are transferred out of the note register 35 at a clock rate controlled by an associated note clock 37 in each of the tone generators. The note clock is a voltage controlled oscillator whose frequency is set to 64 times the fundamental frequency of the keyed note on the keyboard. Thus all 64 data points are transferred to the digital-to-analog converter 47 in a time interval corresponding to one period at the pitch or fundamental frequency of the selected note.

There are a variety of methods for implementing the voltage controlled oscillator used for the note clock 37. One such implementation is described in detail in U.S. Pat. No. 4,067,254 which is hereby incorporated by reference.

The number of data points in the master data set is a function of the maximum number of harmonics desired for the generated tonal structure. The rule is that the maximum number of harmonics is equal to one-half of the number of data points defining a full cycle of the audio waveshape. Thus, the preferred embodiment uses 64 data points which permits the generation of tones having a maximum of 32 harmonics.

As further described in the above-identified U.S. Pat. No. 4,085,644, it is desirable to be able to continuously recompute the master data set which resides in the main register 34 and to reload this data in the note register 35 while the associated key on the keyboard remains depressed. This is accomplished without interrupting the flow of data points to the digital-to-analog converter at the note clock rate.

The present invention is directed to an arrangement for simultaneously constructing the master data in two components having only one-half the number of data points. As described below these two components can be computed in a fraction of the computation cycle time interval and does not lead to a restriction in the maximum number of tonal harmonics.

As described in the above referenced U.S. Pat. No. 4,085,644 the master data set can be calculated according to the relation $$Z_N = \sum_{q=1}^{M} c_q \sin(\pi N q/M) \qquad \text{(Equation 1)}$$

where $N=1,2,\ldots,2W$ is the index number for the master data set words, $q=1,2,\ldots,M$ is the harmonic number, $M=W$ is the number of harmonics used to generate the master data set, and $c_q$ are the harmonic coefficients preselected for a desired output tone quality. Each term in the summation shown in Equation 1 is called a harmonic component.

The reduction in the master data set from 64 to 32 data points is possible because the values of $Z_N$ in the master data set calculated according to Equation 1 has odd symmetry about the midpoint of 32.

In general all master data sets computed according to Equation 1 will not have any predetermined symmetry about the one-quarter cycle point of 16. However, in the manner to be described in the following paragraphs, it is possible to force a one-quarter cycle symmetry without any restrictions on the set of harmonic coefficients used in the algorithm to compute the values of the master data set.

FIG. 1 shows the graphs for the first four harmonics for a full cycle comprising 64 points. The top four graphs illustrate the sine function. The dot-dashed lines are drawn at the one-half cycle point for the fundamental. The sine harmonics all exhibit odd-symmetry about the one-half cycle point. The dashed lines are drawn at the one-quarter cycle points. The odd sine harmonics have an even symmetry about the one-quarter cycle points. Thus if a component master data set is computed using only the odd harmonics, the result will be a set of data points which will be even symmetric about the one-quarter point, point 16, and which will retain the odd-symmetric property about the one-half cycle point, or point 32. Analogously if a component master data set is computed using only the even harmonics, the result will be odd-symmetric about the one-quarter point and will also retain the odd-symmetric property about the one-half cycle point. The two component master data sets can be summed to obtain the required data set of 64 points which is transferred during the transfer cycle to the note registers. The remainder of the 64 points is constructed by appropriate logic which utilizes the above symmetry properties as the master data points are transferred to the note registers.

Figure 2:
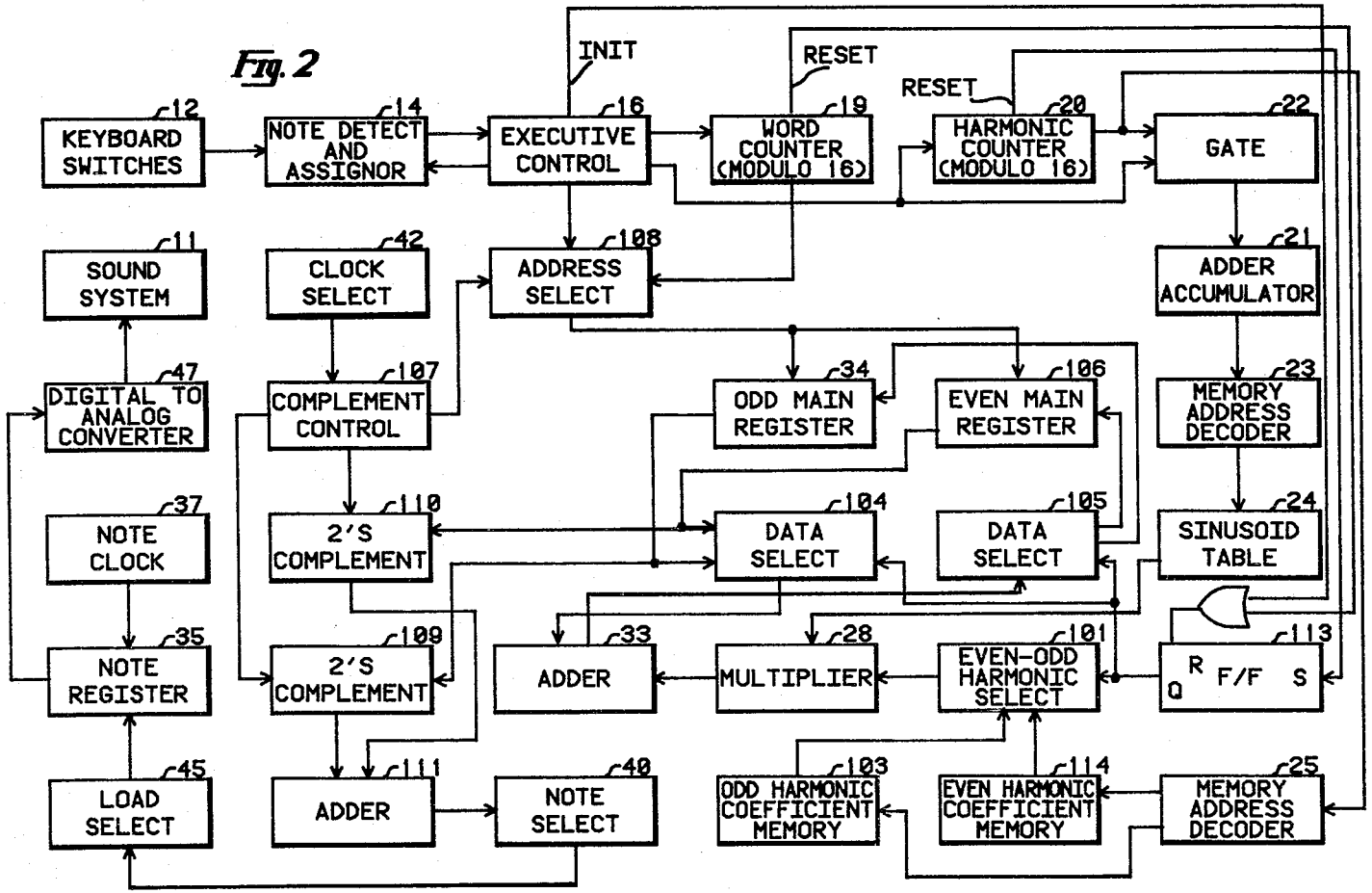
FIG. 2 is a schematic block diagram of one embodiment of the invention.

The master data set computation and transfer to the note registers according to the present invention is shown in FIG. 2. While the circuitry for only one tone generator is shown explicitly, it will be understood that twelve such tone generators including twelve associated note clocks are normally provided in the preferred embodiment of the Polyphonic Tone Synthesizer. In FIG. 2, word counter 19 counts timing pulses from the system master clock and counts modulo 16.

The harmonic counter 20 counts modulo 16 and is incremented each time that word counter 19 returns to its initial state because of its modulo counting action. As described in detail in the above referenced U.S. Pat. No. 4,085,644, the count state of the harmonic counter 20 is transmitted via gate 22 to the adder accumulator 21. The memory address decoder 23 reads values of the stored sinusoid table from sinusoid table 24 in response to the contents of adder accumulator 21.

During a computation cycle, executive control 16 causes the word Counter 19 to be incremented by 32 full counting cycles of 16 counts per cycle.

The harmonic coefficients $c_q$ corresponding to the odd numbered sinusoid harmonics are stored in the odd harmonic coefficient memory 103 while the even numbered sinusoid harmonic coefficients $c_q$ are stored in the even harmonic coefficient memory 114.

At the start of a computation cycle, the executive control 16 creates an INIT signal. The INIT signal is used to reset the flip-flop 113 through a logic OR gate. Each time word counter 19 is reset to its initial state because of its modulo counting, a RESET signal is generated and sent to the memory address decoder 25.

When flip-flop 113 is reset at the start of a computation cycle, the output Q is "0". If Q is "0", the even-odd harmonic select 101 will transfer the odd harmonic coefficients addressed out from the odd harmonic coefficient memory to the multiplier 28. The state Q=0 causes data select 104 to transfer data read out of the odd main register 34 to the adder 33. The state Q=0 causes the output data from adder 33 to be transferred to the odd main register 34 where it is stored at the memory location corresponding to the current count state of the word counter 19. The net result is that during the interval of the computation cycle in which the harmonic counter 20 is at its initial state, the system operates in the manner described in detail in U.S. Pat. No. 4,085,644 to generate data which is stored in the odd main register 34.

The above operation continues during the first portion of the computation during which the word counter 16 is cycled for 16 complete cycles and the harmonic counter 20 is incremented by 15 counts. At the next logic master clock timing pulse, the harmonic counter is reset to initial state because of its modulo count implementation and the harmonic counter generates a RESET signal.

The RESET signal from the harmonic counter is used to set the flip-flop 113 and thereby causing the signal Q to be in the "1" state. When Q is "1", the even-odd harmonic select 101 will transfer the even harmonics addressed out from the even harmonic coefficient Memory 114 by the memory address decoder 25 to the multiplier 28.

While Q=1, data select 104 will transfer data read out of the even main register 106 to the adder 33 and data select 105 will transfer the summed data output from adder 33 to the even main register 106.

At the end of the second 16 counts of the harmonic counter 20, the second portion of the computation cycle is completed. In the above described manner, the computation cycle has been accomplished in $$(\text{word cycles})\times(\text{harmonic cycles})=16\times(16\times 2)=512 \text{ counts.}$$

Without using the even-odd symmetry properties of the sinusoioid values, the computation cycle requires 1,024 counts of the logic clock as described in U.S. Pat. No. 4,085,644.

Figure 3:
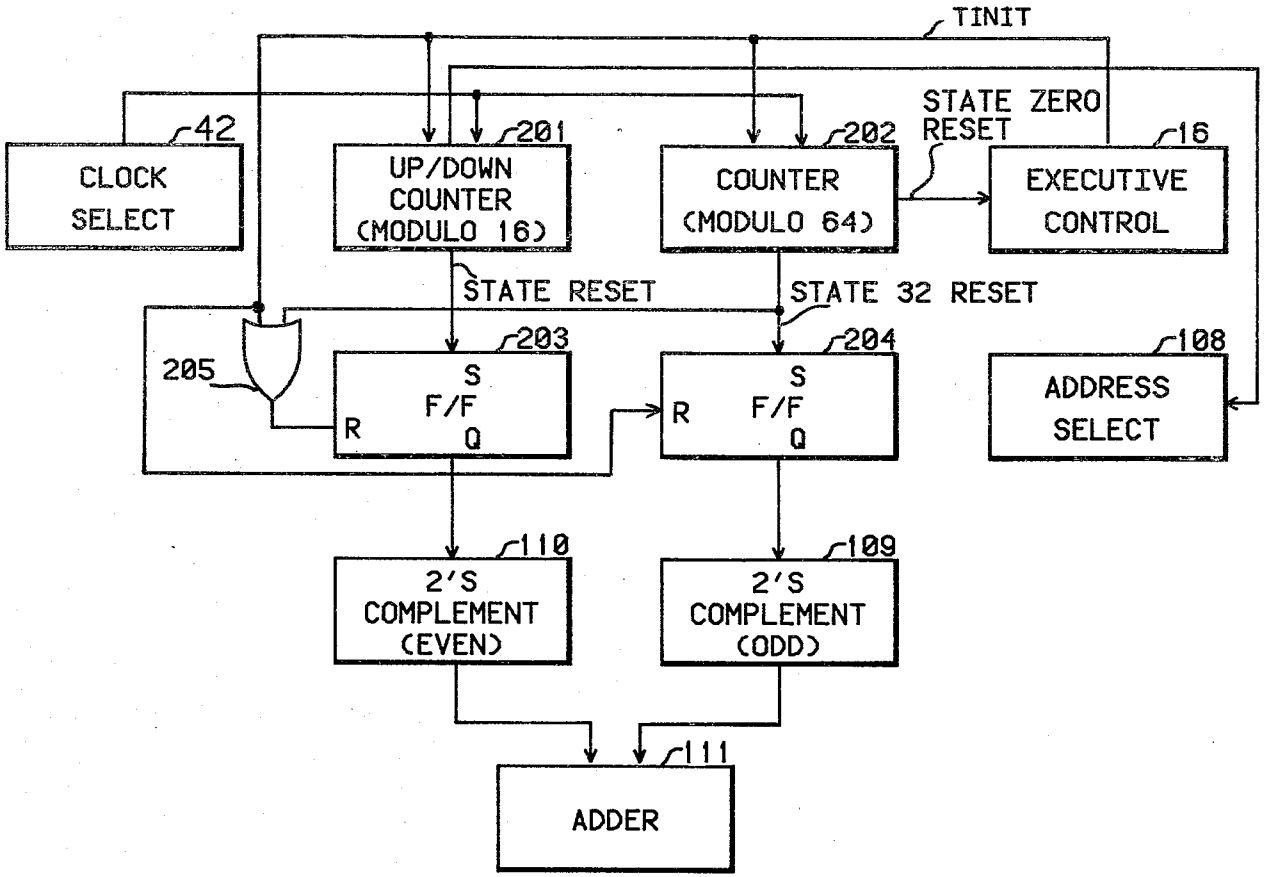
FIG. 3 is a schematic block diagram showing the details of the Complement Control.

During a transfer cycle, the stored data residing in the odd main register 34 and the even main register 106 is read out and combined under the direction of the complement control 107. The details of the complement control are shown in FIG. 3 and are described below. The data read out from the two component main registers are complemented in the prescribed manner. The remainder of the system action following the transfer of data to the note registers is described in U.S. Pat. No. 4,085,644.

Although shift registers have been described for the note registers 35 and the main registers 34 and 106, it is understood that addressable memories can also be used to store the information resident in the note and main registers.

While only a single set of even and odd harmonic coefficient memories are shown in FIG. 1, these are understood to represent a single pair of a multiplicity of such sets of memories which can be selected by the setting of tone, or stop, switches in the manner described in U.S. Pat. No. 4,085,644.

The details of the complement control 107 circuitry is shown in FIG. 3. The purpose of the complement control is to combine the component master data set data residing in odd main register 34 and even main register 106 into a single master data set consisting of 64 points during a transfer cycle.

At the start of a transfer cycle an TINIT signal is generated by the executive control 16. The presence of this TINIT signal is used to reset the up/down counter 201, the counter 202, flip-flop 203, and flip-flop 204.

Counters 201 and 202 are incremented by timing clock signals transferred by clock select 42. The manner in which these clock signals are selected is described in U.S. Pat. No. 4,085,644.

The up/down counter 201 counts from 1 to 16 and then from 16 to 1 in a repetitive fashion as it is incremented by the timing signals selected by clock select 42.

For the first 16 count states of up/down counter 201, the output state of flip-flop 203 is Q="0". In response to the state Q="0", the 2's complement 110 does not perform any alteration on the data it receives from the even main register 106 before it is transferred to the adder 111. Thus the first 16 words addressed from the even main register 106 during the transfer cycle are transferred unaltered to the adder 111.

For the first 32 count states of the counter 202, the output state of flip-flop 204 is Q="0". When the state of flip-flop 204 is Q="0", the 2's complement 109 does not perform a 2's complement on its input data. Therefore, the first 32 adressed words from the odd main register 34 will be transferred unaltered to the adder 111.

When the up/down counter 201 reverses its count direction and when it has been incremented seventeen times, a STATE RESET signal is generated which is used to set the flip-flop 203 so that its output state changes to Q="1". In response to the state Q="1", the 2's complement 110 will perform a 2's complement on the binary data words received from the even main register before this data is sent to the adder 111. The net result is that for the corresponding data word addresses 17 to 32 in the note register 35, (or any other note register that has been assigned to be loaded during a transfer cycle) the even main register 106 data word contents are read out in reverse order, complemented and added to the contents of the odd main register 34 which during this same set of clock timing pulses are also being read out in reverse order.

The data read out addresses for the odd and even main registers is selected by address select 108 under command by the executive control 16. During the transfer cycle, the main register data addresses are taken from the states of the up/down counter 201.

When the Counter 202 is incremented to its count state 33, a STATE 32 RESET signal is generated and sent to set flip-flop 204 so that its output state becomes Q="1". Therefore in response to the state Q="1" for flip-flop 204, the 2's complement 109 will perform a 2's complement operation on the binary data received from the odd main register 34 before this data is transferred to the adder 111. The STATE 33 RESET signal generated by counter 202 is also used to reset flip-flop 203 via logic OR gate 205.

During timing counts from 33 through 64, flip-flop 204 has its output state set at Q="1", so that the 2's complement 109 will perform a 2's complement on all the data addressed out from the odd main register 34.

At count 33, as described above, flip-flop 203 has been reset so that its output state is Q="0". Consequently for timing counts inthe transfer cycle from 33 through 48, the 2's complement will not complement the data addressed out from the even main register 106.

At count 49 of the transfer cycle, up/down counter 201 again reverses its count direction and generates the STATE RESET signal which, as described above, places the flip-flop 203 into the state Q="1". As a result, for counts 49 through 64, the data addressed out from the even main register 106 will have a 2's complement operation performed before the data is transferred to the adder 111.

At the 65'th count, a STATE ZERO RESET signal is generated by counter 202. This STATE ZERO RESET is sent to the executive control 16 which then terminates the transfer cycle.

An alternative to the system shown in FIG. 2 is to use a stored set of cosine function values, or other even-symmetric orthogonal functions as described in U.S. Pat. No. 4,085,644. If cosine functions are stored in the sinusoid table 124, then the values of the master data set are computed byan analogous relation to that shown in Equation 1 in which the sine values of the indicated arguments are replaced by the cosine values of the same arguments.

The bottom four graphs in FIG. 1 illustrate the symmetric properties of the cosine function harmonics. The odd cosine harmonics have an odd symmetry about the one-quarter cycle points while the even cosine harmonics have an even symmetry about the one-quarter cycle points. All the cosine harmonics have an even symmetry about the one-half cycle point. Therefore if a component master data set is computed using only the odd cosine harmonics, the result will be a set of data points which will be odd-symmetric about the one-quarter point, point 16, and which will retain the even-symmetric property about the one-half cycle point, or point 32. Analogously if a component master data set is computed using only the even cosine harmonics, the result will be even-symmetric about the one-quarter point and will also exhibit the even-symmetric property about the one-half cycle point. Two such component master data sets, consisting each of 16 points, can be complemented and summed in a specified manner to obtain the required 64 data points to be stored in the note registers.

The system shown in FIG. 2 is readily modified when even symmetric orthogonal functions, such as cosine trigonometric, are stored in the sinusoid table 24. The required change is to interchange the input data lines to the 2's complement 110 and 2's complement 109.

The preceeding remarks, and the system shown in FIG. 2, all apply if generalized orthogonal functions are used in the sinusoioid table 24 in place of the trigonometric functions in the manner described in U.S. Pat. No. 4,085,644.

A simplification in the sinusoid table can be obtained in a well-known manner by only storing one quadrant of the sinusoid values. The required full cycle values of the sinusoid values can be addressed out from the table by means of the memory address decoder 23 which operates by using the symmetry of a sinusoid. For example if the sine functions are stored, the second quarter cycle points are obtained by addressing the first quarter cycle in reverse (or quarter-cycle complemented) order. The third quarter cycle points are the negative of the first quarter cycle points and the fourth quarter cycle points are the negative of the first cycle points addressed in reverse order.

The addressing logic for the memory address decoder 23, as well as that for addressing data from the odd and even main registers can be simplified by using a slightly modified table of sinusoid function values stored in sinusoid table 24. The modified values are obtained by making the change of variable $$N' = (2N-1)/2 \quad \text{(Equation 2)}$$

in Equation 1. The equivalent relation for generating the master data set is $$Z_N = \sum_{q=1}^{M} c_q \sin(\pi N' q/2M) \quad \text{(Equation 3)}$$

values of sin ($\pi$N'/2M) are stored in the sinusoid table are addressed by the values N'q instead of the values of Nq.

Figure 4:
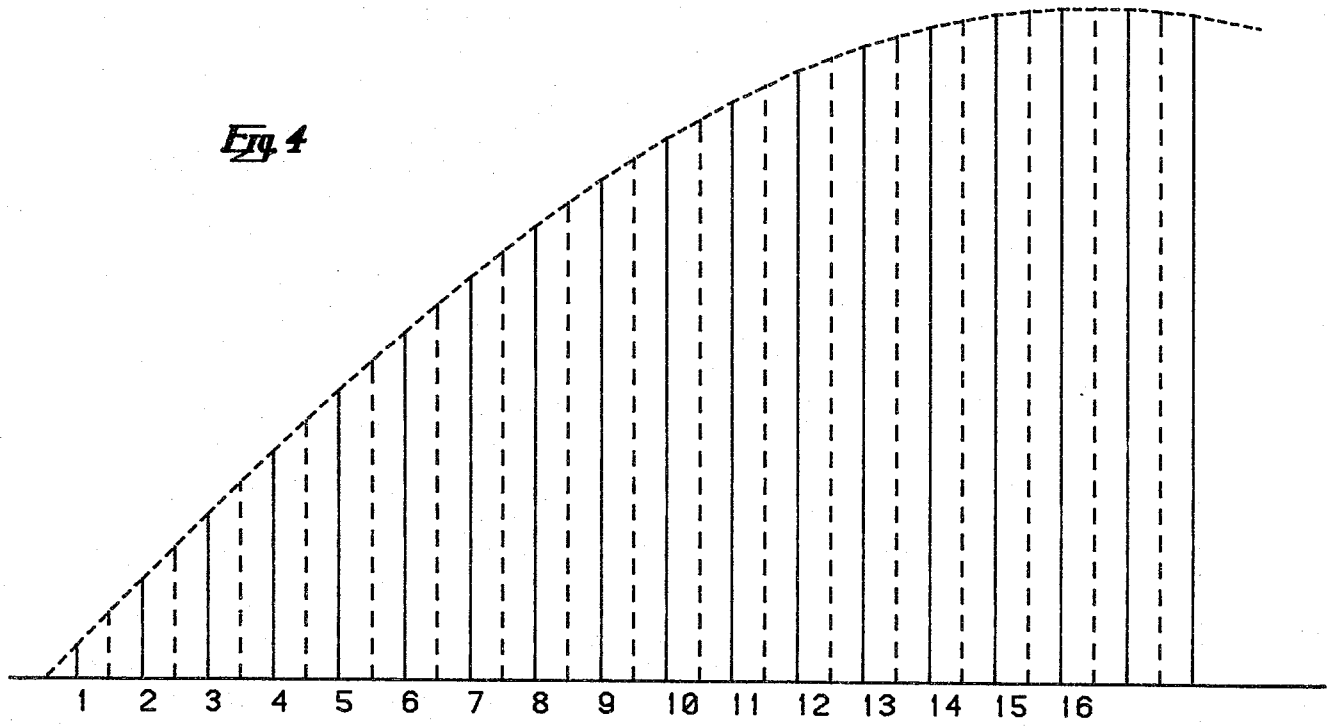
FIG. 4 is a graphic illustration of the sinusoid table addresses.

FIG. 4 illustrates the symmetric properties of a sinusoid that motivates the change of addressing variable in Equation 2. In FIG. 4 the solid vertical lines indicate the values of sin (N/M) for integer values of the variable N. Notice that the value for N=16 is a distinct point while points 15 and 17 are equal, 14 and 18 are equal, and so on. Thus a simple up/down counter address will not by itself act as a suitable addressing means to obtain the complete set of sinusoid from a single quadrant of stored values. The dotted lines in FIG. 4 indicate the values of sin (N'/M) for integer values of N. For the solid lines the values of 16 and 17 are equal, 15 and 18 are equal, and so on. Therefore a conventional up/down counter can readily address such a set of values by counting to 16, repeating the count 16 and then reversing and counting back to 1.

Figure 5:
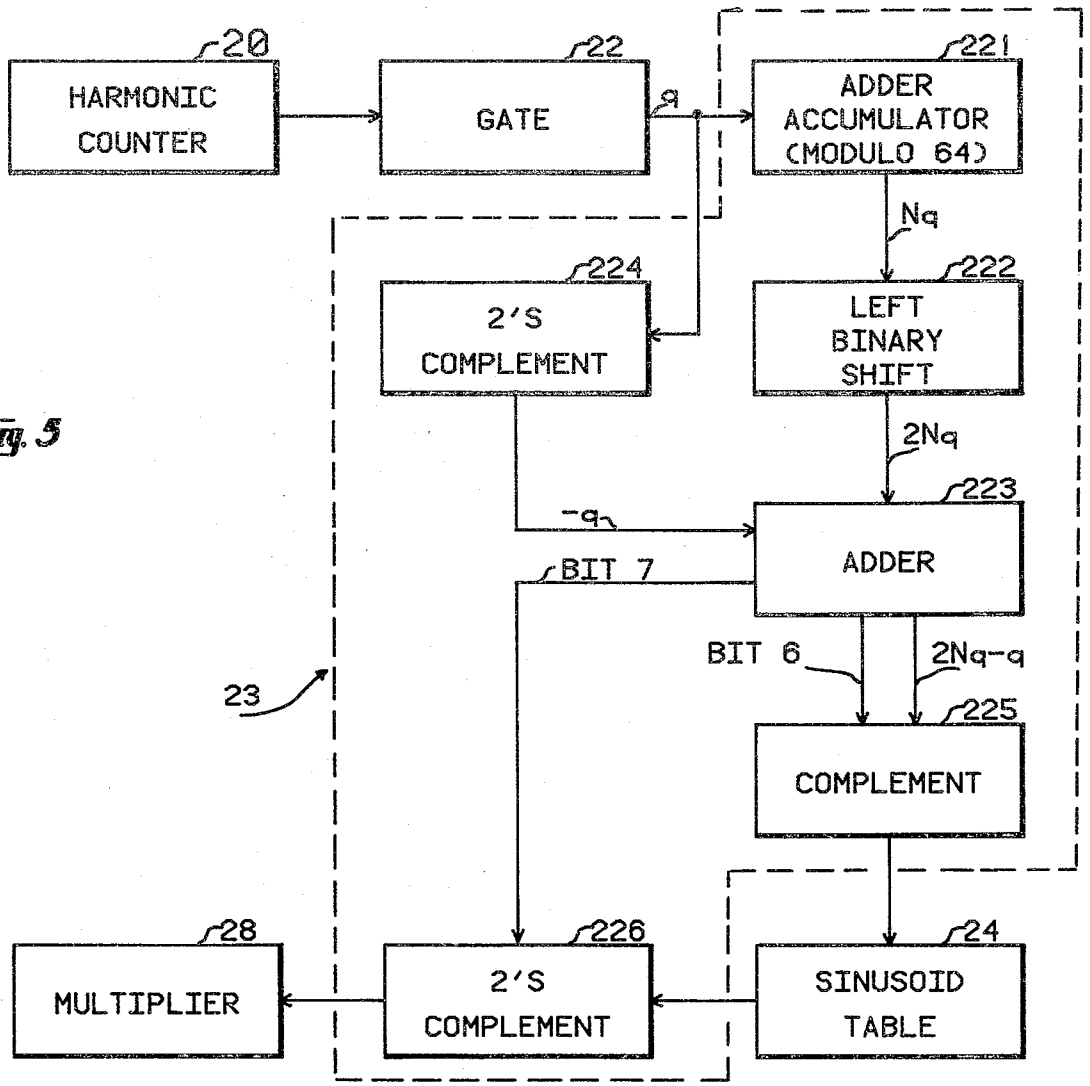
FIG. 5 is a schematic block diagram of the sinusoid table memory address decoder.

FIG. 5 shows the details of the circuitry of the memory address decoder 23 implemented to supply sinusoid table addresses corresponding to those required by the use of Equation 3.

Adder accumulator 221 contains the values of Nq which result from successively adding to itself the contents of the harmonic counter 20. Because of the combination action of the left binary shift 222 and the 2's complement 224, adder 223 will contain the desired quantity N'q=(2N−1)q. If the sinusoid table has 16 points for a quadrant corresponding to a full cycle of 64 sinusoid points for a master data set capability of 32 harmonics, then a simple well-known addressing scheme can be used to obtain the full cycle of sinusoid values from the stored single quadrant.

The logic for extending the single quadrant of sinusoid values to a full cycle is controlled by the values of selected bits in the binary words contained in adder 223. The least significant bit is numbered "1" and the most significant bit is numbered "7". Only bits 2 to 4 in adder 223 are used to address data values stored in the sinusoid table 24. If bit 6 is "1", then bits 2 to 4 are complemented by complement 225 before they are used as a memory address. This will occur when the data residing in adder 223 corresponds to sinusoid table addresses for quadrants 2 and 4. When bit 7 is "1", the data values addressed out from the sinusoid table are converted to negative values by performing a 2's complement on the binary numbers by means of 2's complement 226. Bit 7 will be "1" for values in adder 223 corresponding to quadrants 3 and 4.

Figure 6:
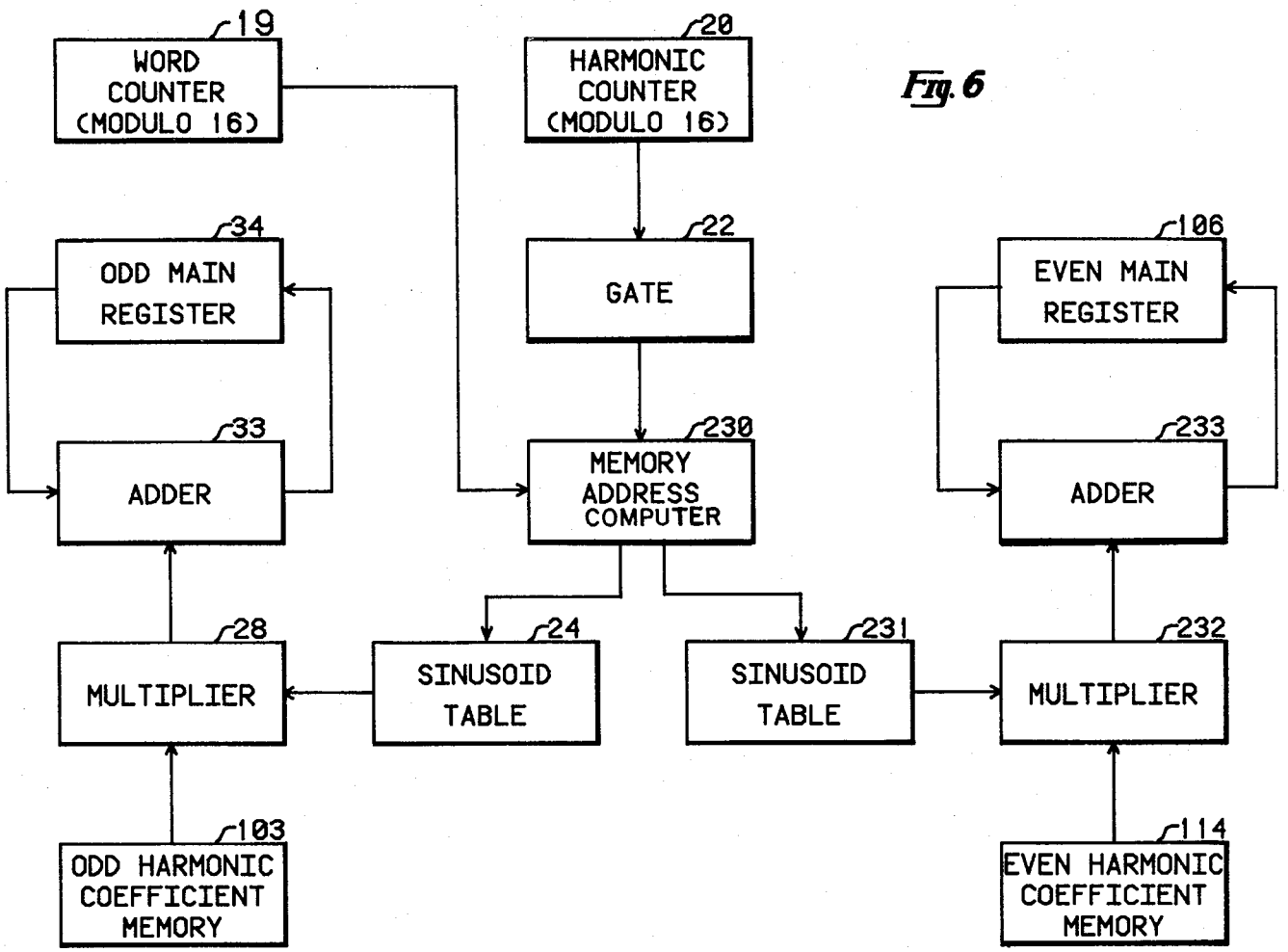
FIG. 6 is a schematic block diagram of a modification to the circuit arrangement of FIG. 2.

FIG. 6 shows an alternative implementation to the basic system shown in FIG. 2 and previously described. The system shown in FIG. 6 reduces the length of time required by the computation by one-half by the expedient of simultaneously computing both the even symmetric and odd symmetric components of the master data set.

In FIG. 6, the system logic blocks used to compute and store the even-symmetric component of the master data set are: sinusoid table 231, even harmonic coefficient memory 114, multiplier 232, adder 233 and even main register 106. The remainder of the corresponding system blocks are used to compute and store the odd-symmetric component of the master data set.

When the master data set values are computed using Equation 3, the odd sinusoid harmonics are addressed from a sinusoid table if $$N'q' = 4Nq - 2q - 2N + 1 \quad \text{(Equation 4)}$$

where q'=2q−1. The even sinusoid harmonics are addressed from a sinusoid when $$N'q'' = 4Nq - 2q \quad \text{(Equation 5)}$$

where q''=2q.

Figure 7:
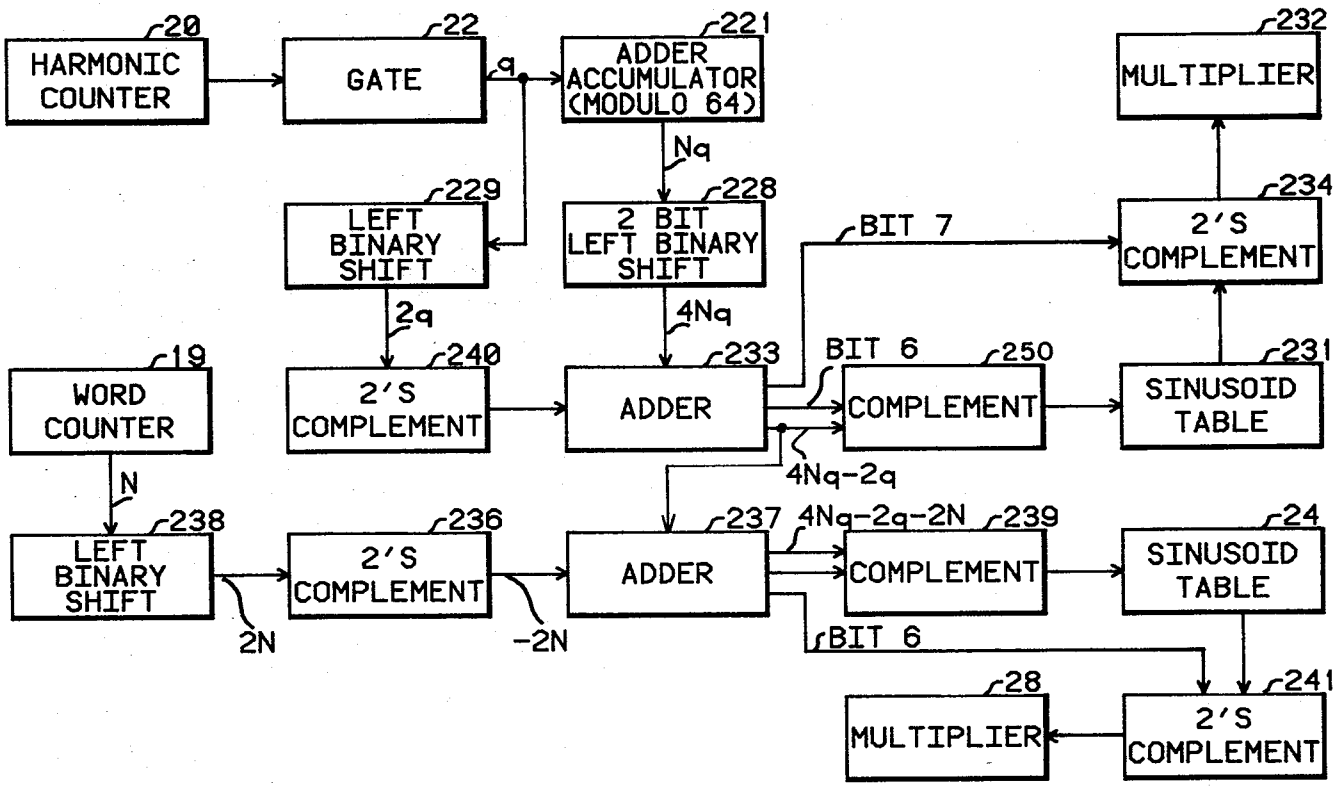
FIG. 7 is a schematic block diagram of the sinusoid table memory address decoder for the system modification shown in FIG. 6.

FIG. 7 shows the details of the memory address computer 230 of FIG. 6 which implements Equation 4 to address odd sinusoid harmonic values from sinusoid table 24 and which also implements Equation 5 to address even sinusoid harmonic values from sinusoid table 231.

The operations performed in cooperation by the left binary shift 229, 2 bit left binary shift 228, and 2's complement 240, produces the desired result of 4N−2q in adder 233 as required by Equation 5. Using the complement operations previously described for the sinusoid table addressing logic in connection with the system shown in FIG. 5, the full cycle of sinusoid values can be obtained from a single quadrant of stored values in sinusoid table 231 from the current data furnished by adder 223. Complement 250, sinusoid table 231, and 2's complement 234 perform similar operations to those previously described in connection with FIG. 5 by complement 225, sinusoid table 24, and 2's complement 226.

The output sum from adder 237 will be the values required by Equation 5. The combination of the left binary shift 238 and 2's complement 236 provides the value −2N as one input to the adder 237. The second input to the adder 237 is the value 4N−2q obtained from the output of adder 233. The complement logic implemented by complement 239 and the 2's complement 241 are used to obtain the full cycle of sinusoid values from a single quadrant of stored values in sinusoid table 241 in a manner analogous to that previously described for the system logic shown in FIG. 5. Complement 239 operates in the manner described for complement 225 and 2's complement 241 operates in the manner described for 2's complement 226.

Figure 8:
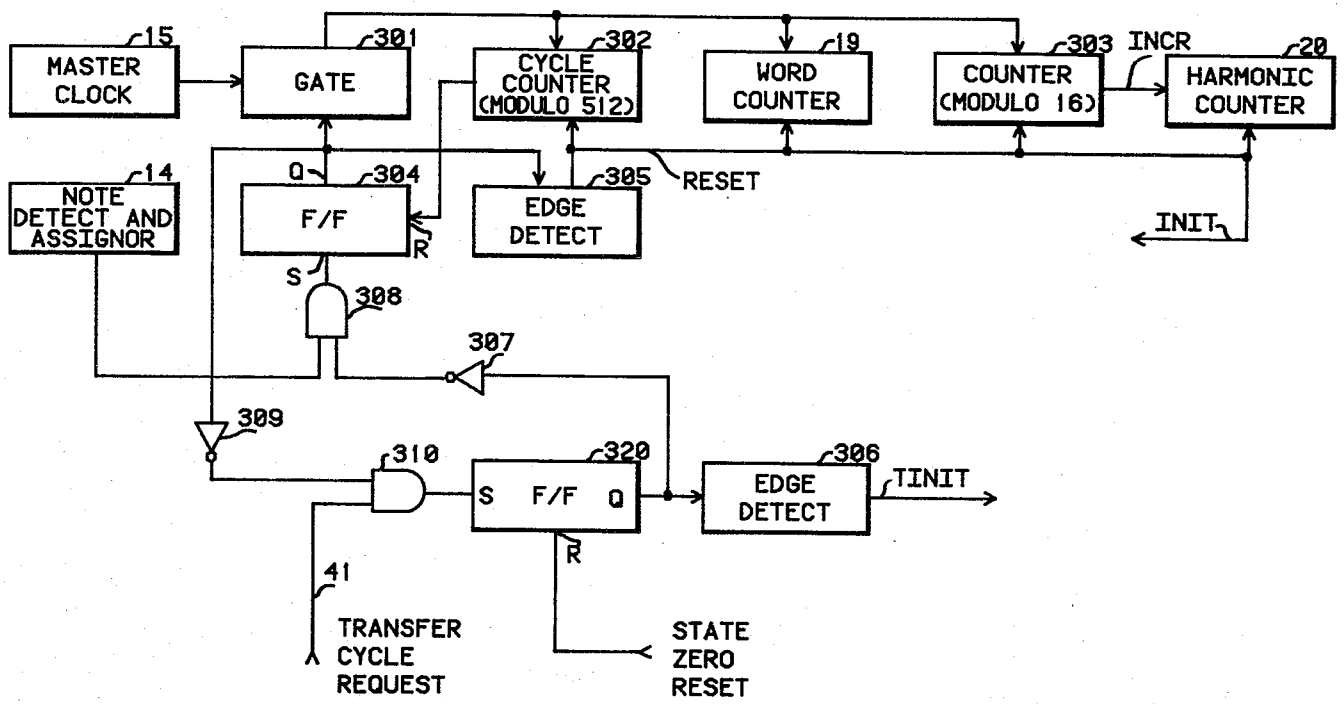
FIG. 8 is a schematic diagram showing details of the Executive Control.

FIG. 8 shows details of the executive control 16. The system logic blocks in FIG. 8 having labels in the 300-number series are elements of the executive control 16. A computation cycle is initiated when flip-flop 304 is set so that its output state is Q="1". Flip-flop 304 can be set at a request from the note detect and assignor 14 if flip-flop 320 has its output state at Q="0". As described below, flip-flop 320 is used to control a transfer cycle and it is desirable that a computation cycle not be initiated while a transfer cycle is in progress. Note detect and assignor 14 will generate a request for the start of a computation cycle if this subsystem has detected that a key has been actuated on the musical instrument's keyboard. Alternative system operation logics are to always initiate a computation cycle when no transfer cycle is taking place, or to initiate a computation cycle at the completion of each transfer cycle.

When flip-flop 304 is set at the start of a computation cycle, the output state Q="1" is converted into a signal pulse INIT by means of edge detect 305. The INIT signal is used to reset counters 302, 19, 303, 20 and for the operations shown and previously described in connection with the system illustrated in FIG. 2.

The state Q="1" causes gate 301 to transfer clock timing pulses from the master clock 15 to increment counters 302, 19, and 303. Counter 303 counts modulo 16 and each time the contents of this counter is reset an INCR signal is generated. The INCR signal is used to increment the harmonic counter 20.

When counter 302 reaches a count state of 512, a reset signal is generated which resets flip-flop 304 so that its output state becomes Q="0". State Q="0" inhibits gate 301 from transferring the master clock timing pulses and thereby terminates the computation cycle.

A transfer cycle request on line 41 will set flip-flop 320 if a computation cycle is not in progress as indicated by a state Q="0" from flip-flop 304. If flip-flop 304 is set then the invertor 309 will place a "0" signal as one input to the AND gate 310. Thus during a computation cycle, AND gate 310 prevents the setting of flip-flop 320 even if a transfer cycle request is present on line 41. The output state Q="1" from flip-flop 320 is converted into a TINIT signal by edge detect 306. This TINIT is used for the transfer cycle complement logic which is shown in FIG. 3 and previously described.

The state zero reset signal, generated in the complement control 107 resets the flip-flop 320 and thereby terminates a transfer cycle. The combination of the invertor 307 and the AND gate 308 prevent the setting of flip-flop 304 while a transfer cycle is in progress. Thus a computation cycle start is inhibited until the transfer cycle is completed.

We claim:

1. In a musical instrument having one or more tone generators in which a plurality of data words corresponding to the amplitudes of a corresponding number of evenly spaced reference points defining the waveform of one cycle of an audio signal are transferred sequentially from a note register to a digital-to-analog converter at a rate proportional to the pitch of the tone being generated the improvement for generating said data words comprising;

means for creating a first and second master data set during a computation cycle comprising a first and second portion and wherein the number of data points in the first and second master data sets are less than one half the number of points defining said waveform, a first memory means for writing said first master data set created during said first portion of the computation cycle to be thereafter read out, a second memory means for writing said second master data set created during said second portion of the computation cycle to be thereafter read out, a third memory means for writing data to be thereafter read out, a transfer means whereby data is read out of said first and second memory means, and a combination means wherein said data read out of said first and second memory means are combined to form a complete cycle of points for said waveform which is written in said third memory means.

2. In a musical instrument according to claim 1 wherein such means for creating a first and second master data set comprises;

a first coefficient memory storing a set of harmonic coefficients each specifying the relative amplitude of a respective one of a set of harmonic components which constitute said first master data set, a second coefficient memory storing a set of harmonic coefficients each specifying the relative amplitude of a respective one of a set of harmonic components which constitute said second master data set, means for separately evaluating each of said harmonic components by multiplying the coefficient value addressed from said first coefficient memory during the first portion of said computation cycle by a sinusoid value associated with the corresponding harmonic component and by multiplying the coefficient value addressed from said second coefficient memory during the second portion of said computation cycle by a sinusoid value associated with the corresponding harmonic component, means for accumulating said harmonic components during first and second portions of said computation cycle thereby obtaining said first and second master data sets for each word thereof, and means for writing said first master data set in said first memory means and for writing said second master data set in said second memory means.

3. A musical instrument according to claim 2 wherein the means for separately evaluating each harmonic component comprises;

a sinusoid table storing sine values, and means for computing numbers $Z_N$ in said first master data set in accordance with the relation $$Z_N = \sum_{q=1}^{M} c_q \sin(\pi Nq/M)$$

where q=1,2,3, . . . , M, N=1,2, . . . , 2M and M is the number of harmonic components defining said number $Z_N$, $c_q$ is an element of the harmonic coefficients stored in said first coefficient memory means and sin ($\pi$Nq/M) is a value addressed from said sinusoid table; and for computing numbers $Y_N$ in said second master data set in accordance with the relation $$Y_N = \sum_{q=1}^{M} d_q \sin(\pi Nq/M)$$

where $d_q$ is an element of the harmonic coefficients stored in said second coefficient memory means.

4. In a musical instrument according to claim 3 wherein said first and second coefficient memory means comprises;

a first coefficient memory means comprising a data storage for a set of odd harmonic coefficients $c_q$ corresponding to odd values q=1,2,3,5, . . . , M-1 for the harmonic number q, and a second coefficient memory means comprising a data storage for a set of even harmonic coefficients $d_q$ corresponding to even values q=2,4,6, . . . , M for said harmonic number q.

5. A musical instrument according to claim 4 wherein said means for computing comprises;

a means for computing numbers $Z_N$ in said first master data set using said odd harmonics coefficients $c_q$ read out of said first coefficient memory whereby said numbers $Z_N$ are odd-symmetric about the quarter-wave point and are odd-symmetric about the half-wave point of said waveform and for computing numbers $Y_N$ in said second master data set using said even harmonic coefficients read out of said second coefficient memory whereby said numbers $Y_N$ are even-symmetric about the quarter-wave point and are odd-symmetric about the half-wave point of said waveform.

6. A musical instrument according to claim 5 wherein said means for computing numbers generates set of numbers $Z_N$ in said first master data set and numbers $Y_N$ in said second master data set for index values $N=1,2, \ldots, P$ where P is the number of data points corresponding to one-quarter of said number 2M for the number points in a complete cycle of said waveform.

7. A musical instrument according to claim 6 wherein said transfer means further comprises;

a timing means whereby timing signals are generated, and an addressing means responsive to said timing signals for causing data to be read out of said first and second memory means.

8. A musical instrument according to claim 7 wherein said addressing means further comprises;

a reversible counter means whereby memory addresses for said first and second memory means are generated in ascending values for the first said number P of said timing signals, are generated in reverse descending values for the second number P of said timing signals, are generated in ascending value for the third number of P of said timing signals, and are generated in reverse descending values for the third number P of said timing signals.

9. A musical instrument according to claim 8 wherein said combination means further comprises;

a signal generator means responsive to said reversible counter means wherein a control signal is generated when said reversible counter means changes from an ascending count mode to a descending count mode and when the reversible counter means changes from a descending count mode to an ascending count mode, a first algebraic sign means wherein data read out from said first memory means is changed in algebraic sign in response to said control signal, a second algebraic sign means wherein data read out from said first memory means is changed in algebraic sign in response to said control signal, and an adder means wherein data furnished by said first and second algebraic sign means are summed to provide a complete cycle of points for said waveform.

10. A musical instrument according to claim 9 wherein said first algebraic sign means further comprises;

a first control circuitry for generating a first sign signal when said reversible counter changes its count mode after a number of timing signals corresponding to one-half of the number of data points comprising said waveform, a second control circuitry for generating a second sign signal when said reversible counter changes its count mode after a number of said timing signals corresponding to one-quarter of the number of data points comprising said waveform and for generating said second sign signal when the reversible counter changes its count mode after a number of timing signals corresponding to three-quarters of the number of data points comprising said waveform, a first control means responsive to said first sign signal for causing said first algebraic sign means to change the algebraic sign of data read out of said first memory means, and a second control means responsive to said second sign signal for causing said second algebraic sign means to change the algebraic sign of data read out of said second memory means.

11. A musical instrument according to claim 2 wherein the means for separately evaluating each harmonic component comprises;

a sinusoid table storing cosine values, and means for computing numbers $Y_N$ in said first master data set in accordance with the relation $$Y_N = \sum_{q=1}^{M} d_q \cos(\pi Nq/M)$$

where $q=1,2,3, \ldots, M$, $N=1,2, \ldots, 2M$ and M is the number of harmonic components defining number $Y_N$, $d_q$ is an element of the harmonic coefficients stored in said second coefficient memory means and $\cos(\pi Nq/M)$ is a value addressed from said sinusoid table; and for computing numbers $Z_N$ in said second master data set in accordance with the relation $$Z_N = \sum_{q=1}^{M} c_q \cos(\pi Nq/M)$$

where $c_q$ is an element of the harmonic coefficients stored in said second coefficient memory means.

12. A digital polyphonic tone synthesizer comprising;

a keyboard comprising a plurality of key switches, a plurality of tone switches wherein each setting of the tone switches corresponds to a selection of a predetermined sound waveshape, digital computing means responsive to the setting of said tone switches for generating a first and a second master data set each having words corresponding to a succession of points on one-quarter cycle of said selected sound waveshape, a plurality of registers, transfer means responsive to the setting of any said key switches whereby said first and second master data sets are combined to form a complete cycle of said selected sound waveshape and whereby the combination is transferred from said digital computing means to selected members of said plurality of registers, a plurality of variable frequency clock generators each associated with a member of said plurality of registers whereby associated registers are shifted at a selected clock rate, means responsive to operation of any member of said plurality of key switches fot setting the frequencies of said clock generators to predetermined values assigned to key switches, digital-to-analog convertor means coupled to said plurality of said registers, and means for repeatedly shifting stored combined master data set in each member of said plurality of registers serially to said digital-to-analog convertor means in synchronism with said associated clock generator, whereby digital-to-analog convertor means generates a plurality of analog output signals each having a fundamental frequency determined by a selected key on said keyboard and a waveshape determined by the setting of said tone switches.

* * * * *